United States Patent [19]

Batson

[11] 4,397,405

[45] Aug. 9, 1983

[54] VALVE SHUTOFF SYSTEM FOR FUEL DISPENSING APPARATUS

[75] Inventor: Bradley L. Batson, Hebron, Conn.

[73] Assignee: Veeder Industries Inc., Hartford, Conn.

[21] Appl. No.: 308,779

[22] Filed: Oct. 5, 1981

[51] Int. Cl.[3] ..... B67D 5/08

[52] U.S. Cl. ..... 222/14; 222/20; 222/71

[58] Field of Search ..... 222/34, 37, 73, 14, 222/16, 63, 15, 17–21, 71; 194/13, 3, 5; 251/44; 137/599

[56] References Cited

U.S. PATENT DOCUMENTS

| | | | |
|---|---|---|---|
| 1,929,719 | 10/1933 | Werder . | |
| 2,264,344 | 12/1941 | Svenson | 222/36 |
| 2,814,444 | 11/1957 | Bliss . | |
| 2,846,119 | 8/1958 | Robbins | 222/20 |
| 3,138,289 | 5/1964 | Jones, Jr. et al. . | |
| 3,159,310 | 12/1964 | Rafferty | 222/63 |
| 3,185,344 | 5/1965 | Kenney | 222/20 |
| 3,206,071 | 9/1965 | Boudot | 222/20 |
| 3,254,795 | 6/1966 | Mackie . | |
| 3,558,011 | 1/1971 | Tracy | 222/20 |
| 3,724,808 | 4/1973 | Sugden, Jr. | 251/30 |
| 3,823,751 | 10/1953 | Healy . | |
| 4,057,173 | 11/1977 | Tal | 222/20 |
| 4,058,286 | 11/1977 | Berger | 222/20 |
| 4,247,899 | 1/1981 | Schiller et al. . | |

*Primary Examiner*—Joseph J. Rolla
*Assistant Examiner*—Patricia Kridler
*Attorney, Agent, or Firm*—Prutzman, Kalb, Chilton & Alix

[57] ABSTRACT

Fuel dispensing apparatus having a high-flow valve downstream of the fuel delivery hose and a solenoid operated pilot valve for the high-flow valve and a solenoid operated low-flow valve upstream of the fuel delivery hose. Flexible tubes within the fuel delivery hose connect the pilot valve to the high-flow valve and connect both pilot and low-flow valves for conducting fuel to downstream of the high-flow valve.

7 Claims, 2 Drawing Figures

VALVE SHUTOFF SYSTEM FOR FUEL DISPENSING APPARATUS

TECHNICAL FIELD

The present invention relates generally to fuel dispensing apparatus of the type having a fuel delivery line with a flexible fuel delivery hose and a manually operable fuel dispensing nozzle at the downstream end of the hose and relates more particularly to a new and improved valve shutoff system for such fuel dispensing apparatus having notable utility in self-service fuel dispensing systems, for example in preset operated systems which provide for terminating a fuel delivery after a preset volume or cost amount of fuel is dispensed.

BACKGROUND ART

In fuel dispensing apparatus of the type described, a valve shutoff system conventionally is provided upstream of the fuel delivery hose and such that when the valve shutoff system is opened to activate the apparatus for dispensing fuel, fuel is thereupon supplied under pressure to the fuel delivery hose. If the hose pressure had been relieved at the end or after the immediately preceding fuel delivery by opening the usual dispensing nozzle valve after the valve shutoff system is closed, the flexible hose is expanded or dilated slightly by the fuel under pressure supplied to the hose when the apparatus is reactivated for the succeeding delivery. As a result, there is a small volume of fuel flow to the hose even before any fuel is manually dispensed from the nozzle. Also, that small amount of fuel flow is displayed by the usual register conventionally provided for displaying the volume and cost amounts of fuel delivered. Thus, although the volume amount of fuel resulting from hose dilation may be relatively small, because of the existing high and expected even higher unit volume price of gasoline, the corresponding cost amount of fuel may be two or three cents or more. As a result, the cost registration system appears inaccurate, and objections may be raised by the fuel customers.

Prior art systems have been devised which provide a shutoff valve downstream of the hose to maintain the hose pressurized between fuel deliveries and so that when the downstream shutoff valve is opened to activate the system for dispensing fuel, the volume and cost registers remain at zero until fuel is actually dispensed.

Werder U.S. Pat. No. 1,929,719; Healy U.S. Pat. No. 3,823,751; Mackie U.S. Pat. No. 3,254,795; and Jones, Jr. et al. U.S. Pat. No. 3,138,289 disclose fuel dispensing systems having a shutoff valve downstream of the hose for deactivating the system after a preset amount of fuel is dispensed. However, such prior art systems have not been extensively used if at all because of their impractical design and because they fail to comply with the strict regulations dealing with the safety and accuracy of fuel dispensing apparatus. For example, such prior art systems do not provide for accurately terminating the fuel delivery after a preset volume or cost amount is dispensed. Also, electrically operated valve shutoff systems which employ a solenoid operated shutoff valve at the nozzle present very serious safety problems and must be designed to avoid electrical fire hazards and therefore are generally considered impractical.

DISCLOSURE OF INVENTION

In accordance with the present invention, a new and improved valve shutoff system is provided having a nonelectrical shutoff valve downstream of the hose and providing a two stage valve shutoff for accurately terminating a fuel delivery after a preestablished amount is dispensed.

In addition, in accordance with the present invention, the new and improved valve shutoff system can be employed with existing fuel dispensing apparatus without substantial modification of the fuel dispensing apparatus and without modification of either the dispensing hose or the dispensing nozzle.

The valve shutoff system of the present invention provides for accurately terminating a fuel delivery in two stages and using a first stage shutoff valve downstream of the hose which upon closure substantially reduces the rate of fuel flow and a second stage valve for accurately terminating a fuel delivery after a predetermined volume or cost amount of fuel is dispensed. Accordingly, the two stage valve shutoff system may be employed with preset equipment used for example in self-service fuel deliveries for automatically terminating the fuel delivery after a predetermined volume or cost amount is dispensed.

The new and improved valve shutoff system of the present invention is also useful with both attended and self-service fuel deliveries where the fuel delivery is not automatically terminated after a preset volume or cost amount of fuel is dispensed and for example where the valve shutoff system is manually operated by the attendant or self-service customer after any desired amount of fuel is dispensed.

Further, the new and improved valve shutoff system of the present invention employs conventional solenoid operated valves for activating and deactivating the dispensing system and whereby the solenoid operated valves may be energized and deenergized at the beginning and end of a fuel delivery with solenoid valve control systems conventionally employed in fuel dispensing systems for that purpose.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figure 1:
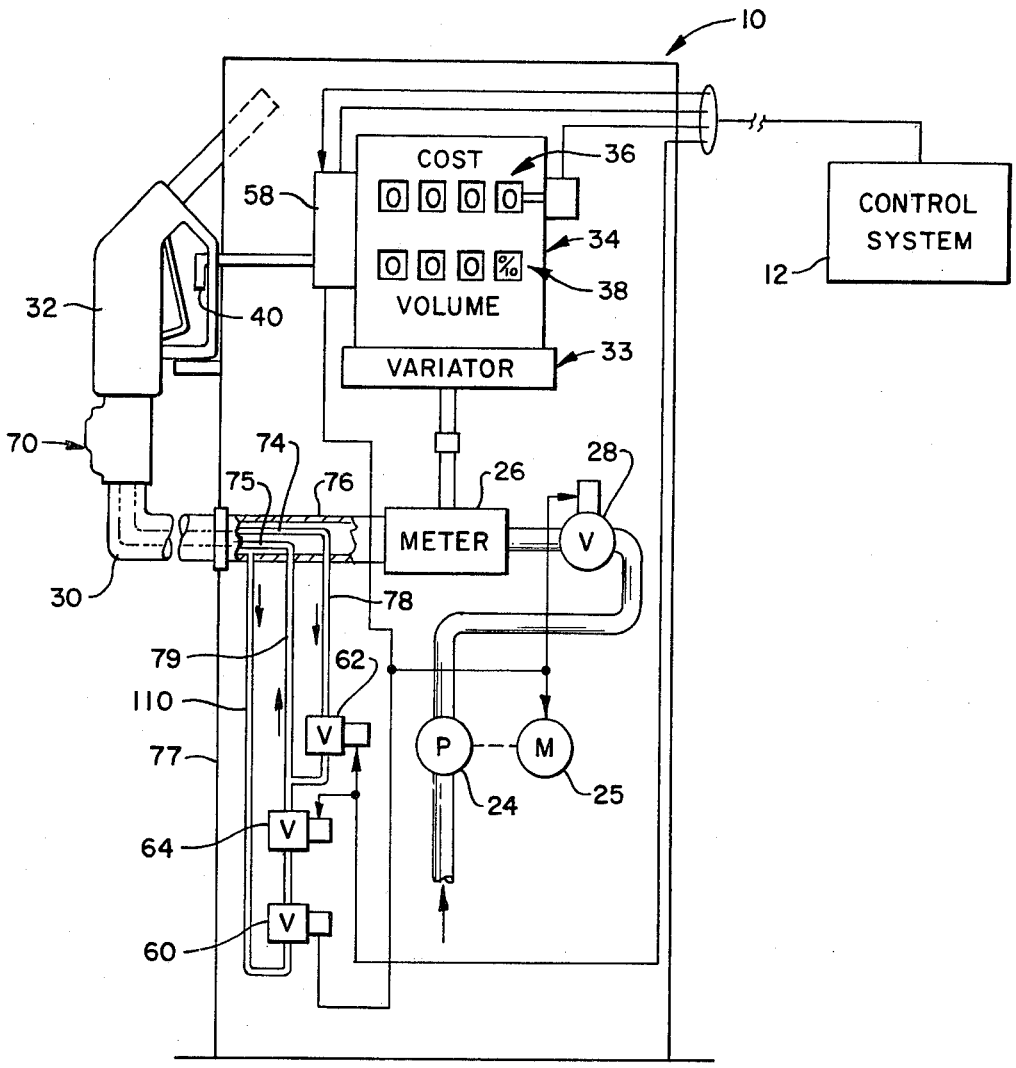
FIG. 1 is a generally diagrammatic view, partly broken away and partly in section, of a fuel dispensing system incorporating an embodiment of a valve shutoff system of the present invention.

Referring now to the drawing in detail wherein like numerals represent like parts, a fuel dispensing system incorporating an embodiment of a valve shutoff system of the present invention is shown comprising a gasoline pump or dispenser 10 electrically connected to be remotely controlled by a suitable control system 12. The control system 12 may be employed with a plurality of pumps or dispensers 10, and, except as hereinafter described, the control system 12 and each dispenser 10 may be identical to that shown and described in U.S.

Pat. No. 4,247,899 of R. J. Schiller et al., dated Jan. 27, 1981 and entitled "Fuel Delivery Control and Registration System". Accordingly, the disclosure of U.S. Pat. No. 4,247,899 is hereby incorporated by reference and the details of the control system 12 are not described herein.

Briefly however, the control system 12 disclosed in U.S. Pat. No. 4,247,899 is an electronic microprocessor based system which provides for remotely energizing or activating the dispenser 10 for example for self-service delivery of fuel. The electronic control system 12 also provides for deenergizing or deactivating the dispenser 10 for terminating a fuel delivery. For example, the electronic control system 12 provides for automatically terminating a fuel delivery after a pre-set volume or cost amount of fuel has been dispensed. Also, the dispenser 10 can be manually deactivated at the dispenser with an on-off pump control handle 40 merely by manually turning the control handle 40 to its vertical or "off" position.

In a conventional manner, the gasoline dispenser 10 has a fuel pump 24 driven by a motor 25 for supplying fuel under pressure for being dispensed. The fuel is supplied under pressure to a fuel dispensing nozzle 32 via a normally closed, master solenoid operated shutoff valve 28, a meter 26 and a flexible fuel delivery hose 30. The meter 26 is coupled to a variator 33 to drive the cost and volume counters 36, 38 of a register 34 for registering or displaying the accumulated cost and volume amounts of fuel dispensed. The manual control handle 40 is mounted adjacent a nozzle storage receptacle so that the handle 40 must be manually rotated to its vertical or "off" position before the nozzle 32 can be returned to its storage receptacle. Also, the nozzle 32 must be removed from its storage receptacle to permit the handle 40 to be rotated to its horizontal or "on" position.

When the handle 40 is turned to its "off" position at the end of a fuel delivery, a control switch (not shown) within a reset mechanism 58 is thereby operated to deenergize the pump motor 25 and master valve 28 to deactivate the dispenser 10. When the handle 40 is subsequently turned to its "on" position, the reset mechanism 58 is actuated by the handle 40 to reset the cost and volume counters 36, 38 of the register 34 to zero. The register 34 and register reset mechanism 58 could be of the type disclosed in U.S. Pat. No. 2,814,444 of H. N. Bliss dated Nov. 26, 1957 and entitled "Register", and so that when the handle 40 is rotated to its "on" position, the reset mechanism 58 is mechanically tripped to reset the cost and volume counter 36, 38 to zero.

At the end of the reset cycle, the control switch (not shown) within the reset mechanism 58 is actuated to energize the pump motor 25 and the master valve 28. Also, a normally closed, low-flow or second stage solenoid operated valve 60 is connected to be energized and deenergized with the motor 25 and master valve 28. A normally closed, first stage solenoid operated pilot valve 62 and a normally open, solenoid operated sequencing valve 64 are energized and deenergized by the electronic control system 12 when the dispenser 10 is activated (after the cost and volume counters 36, 38 are reset to zero) and deactivated respectively by the control handle 40. Also, in a preset mode of operation of the electronic control system 12, the first stage pilot valve 62 is closed (i.e. deenergized) and the sequencing valve 64 is opened (i.e. deenergized) by the electronic control system 12 a small incremental amount before a preset cost or volume amount of fuel is dispensed. Subsequently, the low-flow or second stage valve 60 and the master valve 28 are closed (i.e. deenergized) and the motor 25 is deenergized, all by the electronic control system 12, when the exact preset amount is reached. In all modes of operation of the electronic control system 12, the master valve 28, and the three solenoid valves 60, 62, 64 and the motor 25 are deenergized substantially simultaneously when the on-off handle 40 is turned to its "off" position.

In accordance with the present invention, a pilot valve operated first stage valve 70 is provided between the nozzle 32 and the upstream end of the fuel delivery hose 30. For that purpose, the first stage valve 70 has axially aligned female and male pipe fittings for installing the valve 70 between the hose 30 and nozzle 32 without modification of either the hose 30 or the nozzle 32. The valve 70 is hydraulically operated by the pilot valve 62 and is connected to the pilot valve 62 via a pair of flexible plastic fuel tubes or conduits 74, 75. The flexible tubes 74, 75 are loosely mounted within and extend the full length of the flexible hose 30 between the downstream first stage valve 70 and an upstream pipe 76 in the dispenser housing 77 to which the upstream end of the flexible hose 30 is suitably coupled. Suitable connectors (not shown) are provided on the pipe 76 for connecting the upstream ends of the flexible tubes 74, 75 to pipes 78, 79 respectively which are connected to the inlet and outlet of the pilot valve 62.

The flexible tubes 74, 75 may for example have a $\frac{1}{8}$ inch inside diameter and an outside diameter less than $\frac{1}{4}$ inch so that the tubes can be easily fed through the flexible hose 30 and so that the flexible hose 30 does not have to be modified in any way. Also, since the usual flexible hose 30 has an inside diameter of either $\frac{5}{8}$ inch or $\frac{3}{4}$ inch, the flow through the flexible hose 30 is not significantly affected by the two inserted tubes 74, 75.

Figure 2:
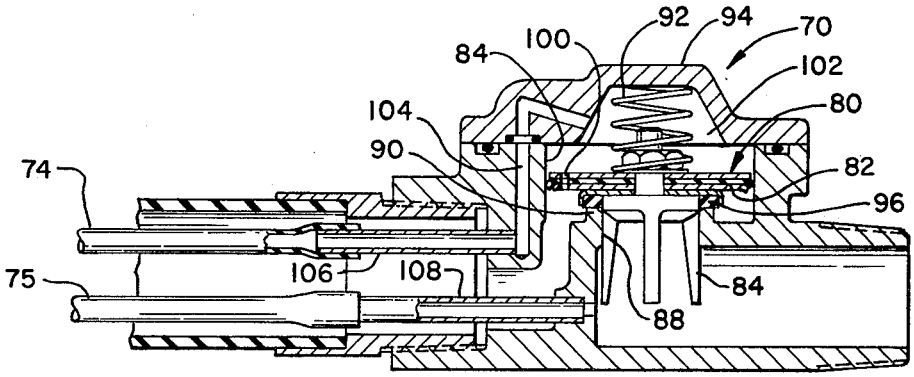
FIG. 2 is an enlarged longitudinal section view, partly broken away and partly in section, showing a first stage shutoff valve of the valve shutoff system.

The high-flow or first stage valve 70 may have a generally conventional construction. As shown in FIG. 2, the valve 70 has a valve member 80 with a first relatively large piston 82 reciprocable within a first cylindrical chamber 84 and a second relatively small guide piston reciprocable in a coaxial cylindrical outlet bore 88. The valve member 80 is biased inwardly into engagement with an annular valve seat 90 encircling the outlet bore 88 by a coil compression spring 92 positioned between the piston 82 and a valve housing cap 94. In the closed position of the valve member 80, an annular seal 96 of the valve member 80 engages the valve seat 90 to completely shut off fuel flow through the outlet bore 88.

Fuel under pressure upstream of the valve 70 is conducted via an orifice 100 in the piston 82 to a valve operating chamber 102 above the piston 82. The valve operating chamber 102 is connected to the flexible tube 74 via a passageway 104 in the valve housing and a male connector tube 106 which receives the downstream end of the flexible tube 74. The downstream end of the other flexible tube 75 is connected to the outlet or downstream end of the valve 70 by a similar male connector tube 108.

When the pilot valve 62 is opened, fuel in the valve operating chamber 102 is exhausted or conducted from the chamber 102 to the downstream end of the valve 70 via the tube 74, pilot valve 62 and the tube 75. As a result, fuel inlet pressure on the inner side of the piston 82 will open the valve 70. When the pilot valve 62 is closed, the fuel supplied to the valve operating chamber 102 via the orifice 100 will close the valve 70. In that regard, the valve closure spring 92 in combination with the fuel pressure in the operating chamber 102 on the outer side of the piston 82 will be greater than the fuel pressure on the inner side of the piston 82 to close the valve 70. With the valve 70 closed, the larger effective area of the piston 82 on its outer side ensures that the valve member 80 remains closed as long as the pilot valve 62 remains closed. Also, the valve member 80 preferably closes rapidly after the pilot valve 62 is closed. For that purpose the orifice 100 is made sufficiently large to close the valve 70 quickly after the fuel exhaust line 74 is closed by the pilot valve 62.

The normally open sequencing valve 64 is provided in series with the second stage solenoid valve 60 to provide for energizing the first stage and second stage solenoid valves 62, 60 at the beginning of a fuel delivery in a conventional manner and with existing equipment. However, even though both solenoid valves 60, 62 are opened at the beginning of a fuel delivery, second stage fuel flow via the second stage valve 60 is prevented by the closed sequencing valve 64. Accordingly, when the pilot valve 62 is open, all of the fuel flowing through the flexible tube 75 to the outlet end of the valve 70 is conducted from the valve operating chamber 102. Otherwise, the high pressure fuel from a second stage supply line 110 could reduce and even prevent fuel flow from the valve operating chamber 102 to hold the valve 70 closed. Alternatively, the low-flow or second stage solenoid valve 60 could be suitably connected to be energized when the pilot valve 62 is deenergized.

When the pilot valve 62 and sequencing valve 64 are deenergized to close the high-flow or primary valve 70, fuel continues to be dispensed at a much slower rate via the low-flow or second stage valve 60 and the open sequencing valve 64. For that purpose, the second stage valve 60 is designed to provide the desired relatively low flow rate before the fuel delivery is automatically terminated after a predetermined or preset amount of fuel has been dispensed.

During the low-flow or second stage fuel dispensing phase, fuel is conducted to the nozzle 32 via the conduit 110, second stage valve 60, sequencing valve 64, conduit 79 and the flexible tube 75. Thus the flexible conduit 75 serves to supply fuel to the nozzle 32 during the second stage operation as well as to conduct fuel from the valve operating chamber 102 to downstream of the valve 70 during first stage operation.

The valve shut-off system provides fail safe operation if power is lost. Fuel cannot be dispensed and the first stage valve 70 remains closed as long as the pilot valve 62 and the second stage valve 60 remain deenergized.

The master solenoid valve 28 is provided as a safety valve for deactivating the entire fuel dispensing system, for example to prevent the dangerous discharge of fuel onto the ground if the hose 30 is ruptured. The master solenoid valve 28 is not required for holding the fuel pressure within the hose 30 when the dispenser 10 is deactivated as the hose 30 will remain pressurized by the fuel captured within the fuel delivery line between the downstream valve 70 and the meter 26. In that regard the conventional fuel meter 26 is a positive displacement multiple piston device having a no-back for preventing reverse rotation of the meter and therefore is capable of maintaining the downstream fuel pressure within the fuel delivery line.

As will be apparent to persons skilled in the art, various modifications, adaptations and variations of the foregoing specific disclosure can be made without departing from the teachings of the present invention.

I claim:

1. In a fuel dispensing apparatus having a fuel delivery line with a flexible fuel delivery hose and a manually operable nozzle at the downstream end of the hose for dispensing fuel, means for supplying fuel under pressure to the fuel delivery line, and a two stage valve system for the fuel delivery line selectively operable for preventing fuel flow and providing relatively high and low fuel flow rates through the fuel delivery line, the improvement wherein the two stage valve system comprises a first stage, fuel pressure operated valve in the fuel delivery line downstream of the fuel hose, the first stage valve being selectively operable by fuel pressure to fully closed and fully open positions thereof and in its open position providing said relatively high fuel flow rate, a pilot valve for the first stage valve having an inlet and an outlet and selectively operable to open and closed positions thereof for operating the first stage valve to its said open and closed positions respectively, a first fuel conduit which includes a first flexible conduit within the fuel hose, connecting the first stage valve to the pilot valve inlet, a second stage valve having an inlet connected to the fuel delivery line upstream of the first stage valve and an outlet and selectively operable to open and closed positions thereof and in its open position being capable of providing said relatively low fuel flow rate, and a second fuel conduit which includes a second flexible conduit within the hose, connecting the outlets of the second stage valve and pilot valve for deliverying fuel therefrom to downstream of said first stage valve.

2. Fuel dispensing apparatus according to claim 1 wherein the first stage valve has a valve chamber, a linear valve member operable within the valve chamber between fully closed and fully open positions thereof and forming a fuel pressure chamber in the valve chamber on one axial side of the linear valve member for fuel pressure operation of the first stage valve between its said open and closed positions, and orifice means for conducting fuel to said fuel pressure chamber from the fuel delivery line upstream of the first stage valve, and wherein the pilot valve is selectively operable for selectively conducting fuel from the fuel pressure chamber to downstream of the first stage valve to open same.

3. Fuel dispensing apparatus according to claim 1 or 2 wherein the pilot valve is a normally closed valve adapted to be selectively opened to open the first stage valve and wherein the two stage valve system comprises a normally open sequencing valve selectively operable to open and closed positions thereof and connected to be closed and opened when the pilot valve is opened and closed respectively, and connected in series with the second stage valve to provide said relatively low fuel flow rate when the second stage valve and sequencing valve are both open.

4. Fuel delivery apparatus according to claim 3 wherein the pilot valve, sequencing valve and second stage valve are solenoid valves adapted to be selectively operated electrically.

5. Fuel delivery apparatus according to claim 4 wherein the two stage valve system comprises a control circuit for selectively energizing the pilot valve and sequencing valve together and for selectively energizing the second stage valve independently of said pilot and sequencing valves.

6. In a fuel dispensing apparatus having a fuel delivery line with a flexible fuel delivery hose and a manually operable nozzle at the downstream end of the hose for dispensing fuel, means for supplying fuel under pressure to the fuel delivery line and a valve system for the fuel delivery line selectively operable for selectively providing fuel flow through the fuel delivery line, the improvement wherein the valve system comprises a first fuel pressure operated valve in the fuel delivery line downstream of the fuel hose, said first valve being selectively operable by fuel pressure to a first fully open position and a second fully closed position thereof for selectively providing fuel flow through the fuel delivery line, a pilot valve for said first valve having an inlet and an outlet and selectively operable to open and closed positions thereof for operating said first valve to its said first and second positions respectively, a first fuel conduit which includes a first flexible conduit within the fuel hose, connecting said first valve to the pilot valve inlet, and a second fuel conduit which includes a second flexible conduit within the hose, connecting the outlet of the pilot valve for deliverying fuel therefrom to downstream of said first valve.

7. Fuel dispensing apparatus according to claim 6 wherein the valve system further comprises means selectively operable for selectively providing fuel flow from the fuel delivery line and via said second fuel conduit from upstream to downstream of the first valve and at a flow rate lower than the flow rate provided through said first valve.

* * * * *